United States Patent [19]

Baker et al.

[11] 4,341,302

[45] Jul. 27, 1982

[54] STORING AND MIXING APPARATUS

[75] Inventors: Andrew J. Baker; Alfred G. Baker, both of Glen Waverley, Australia

[73] Assignee: United Fillers Pty. Ltd., Melbourne, Australia

[21] Appl. No.: 197,123

[22] Filed: Oct. 15, 1980

[51] Int. Cl.[3] ..... B65D 81/32; B65D 1/36; B65D 77/08

[52] U.S. Cl. ..... 206/219; 206/230; 206/568; 222/94

[58] Field of Search ..... 206/219, 229, 230, 568; 229/1.5 C; 222/191, 192, 485, 94

[56] References Cited

U.S. PATENT DOCUMENTS

| | | | |
|---|---|---|---|
| 1,457,998 | 6/1923 | Norwood | 229/1.5 C |
| 3,083,821 | 4/1963 | Woodson | 206/568 |
| 3,491,875 | 1/1970 | Fischer et al. | 206/229 |
| 3,618,751 | 11/1971 | Rich | 206/219 |
| 3,782,600 | 1/1974 | Columbus | 206/229 |

*Primary Examiner*—William T. Dixson, Jr.
*Attorney, Agent, or Firm*—Wells, St. John & Roberts

[57] ABSTRACT

A package comprising an integral tray and separable tool or paddle for delivering material components from one depression of the tray to another and for subsequently mixing them prior to their use. It is designed for storing component materials in a multiple component system, such as a thermosetting resin system. Material is accurately transferred from one depression to the other by the associated tool. The interior surfaces of the depressions are complementary to the configuration of the intersecting edges of the tool or paddle.

6 Claims, 12 Drawing Figures

FIG 9
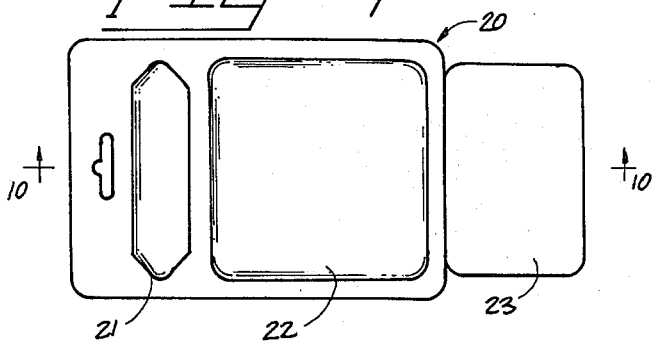
FIG 10
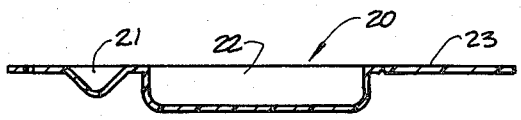
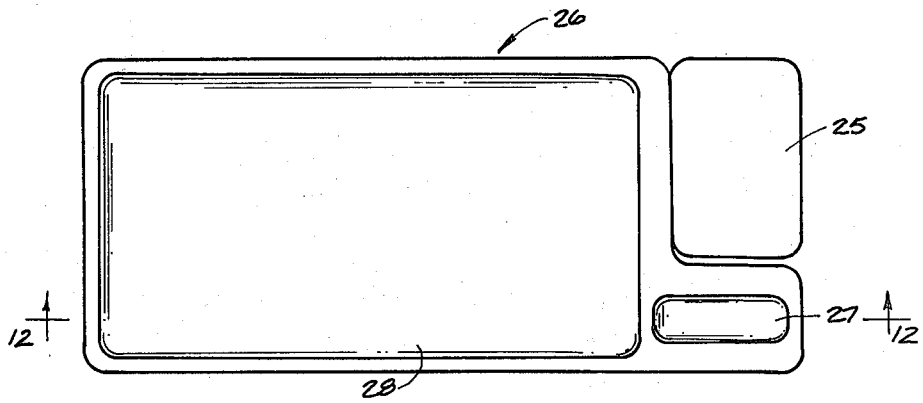
FIG 11
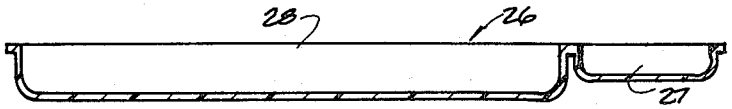
FIG 12

STORING AND MIXING APPARATUS

BACKGROUND OF THE INVENTION

This disclosure relates to a package for two or more material components or substances intended to be mixed together immediately prior to use. It is particularly adapted to the packaging of chemically reactive substances, such as thermosetting adhesives, filler compositions and other resin formulations.

Such thermosetting materials typically comprise a base composition to which is added a curing agent or catalyst which hardens the mixture of the two. Because the curing time is relatively short, these material components can't be premixed and must be delivered to the ultimate user in separate containers or compartments.

The package can also be used for storing and mixing of other products including two or more material components, such as base mixtures and coloring components, extenders, texturing components or other materials required to selectively desirable in the final mixture. As an example, the package might contain a coating composition with one or more separate coloring agents which can be selectively chosen by the ultimate user for final mixing in the present package before application of the coating material.

Storage of chemically reactive substances such as thermosetting resin components has posed many difficulties in package design because of the inherent nature of the substances. They must be completely isolated from one another, since even small amounts of the curing composition will effect a reaction and ultimately harden the base composition. The general practice is to store and deliver individual components or thermosetting compositions in separate containers such as cans or tubes.

In the case of thermosetting, resin fillers, the base composition or putty and the curing agent are supplied in two separate containers. The user removes a selected amount of each material and mixes them in a third container as required for application. This necessitates the use of separate mixing containers and risks inaccurate measurement of the required amounts of both material compositions. In many instances the relative amount of material are critical to the proper functioning of the mixture and inaccurate mixing can lead to failure in the thermosetting system.

Prior patents do show packages for holding two reactive ingredients in a tray structure having an outer removable cover. U.S. Pat. No. 4,008,803 to Smith shows two separate compartments for holding a resin and hardener, together with a separate mixing compartment and a tool for cutting the covering sacs and handling of the chemicals. The tool itself is not shaped to specifically complement the shapes of the package compartments.

Prior U.S. Patent to Marckardt, U.S. Pat. No. 3,756,386 shows a multichamber container with a single recess in the body of the container and a small recess formed in its cover for holding two components. To use this package, the wall separating these recesses is broken and material is squeezed from the smaller recess into the main compartment for mixing.

The U.S. Pat. No. to Franck, 4,081,077 discloses a compartmented package where a mixing tool separates recesses into compartments. The mixing tool serves as a divider to isolate the compartments. Its outer configuration does not otherwise complement the shape of the recesses.

A final patent showing prior use of compartmentalized tray packages in U.S. Pat. No. 3,618,751. It relates to crushing and administering of pills in powder form.

The package illustrated and described herein presents two or more separate compartments arranged about an open tray in close proximity to one another. Each compartment is formed as a depression in the tray, and is adapted to hold a predetermined quantity of material within it. One of the compartments serves a second purpose as a mixing receptacle into which material from the other compartment or compartments can be transferred and mixed with its contents prior to use. The package also comprises a complementary paddle or mixing tool. The upwardly facing ramps presented by the compartments or depressions within the tray are complementary to the edge configurations of the mixing tool to facilitate both removal and mixing of the material components.

More specifically, the present disclosure relates to a package in the form of a rigid tray preferably formed or molded from synthetic resin material. The tray has two or more depressions formed therein for containing two or more separate material components. It also has a planar upper surface defining the upper extremities of the depressions. A cover sheet is secured about the periphery of each depression to enclose the package and physically isolate the material components from one another for storage and shipping purposes. The tray includes an integral mixing tool or paddle. It is joined to it along a line of weakness which permits the tool to be manually separated from the tray prior to its use.

DESCRIPTION OF THE DRAWINGS

FIG. 9 is a top plan view of a third embodiment;

FIG. 10 is a sectional view taken along line 10—10 in FIG. 9;

FIG. 11 is a top plan view of a fourth embodiment;

FIG. 12 is a sectional view taken along line 12—12 in FIG. 11.

DESCRIPTION OF THE PREFERRED EMBODIMENTS

Figure 1:
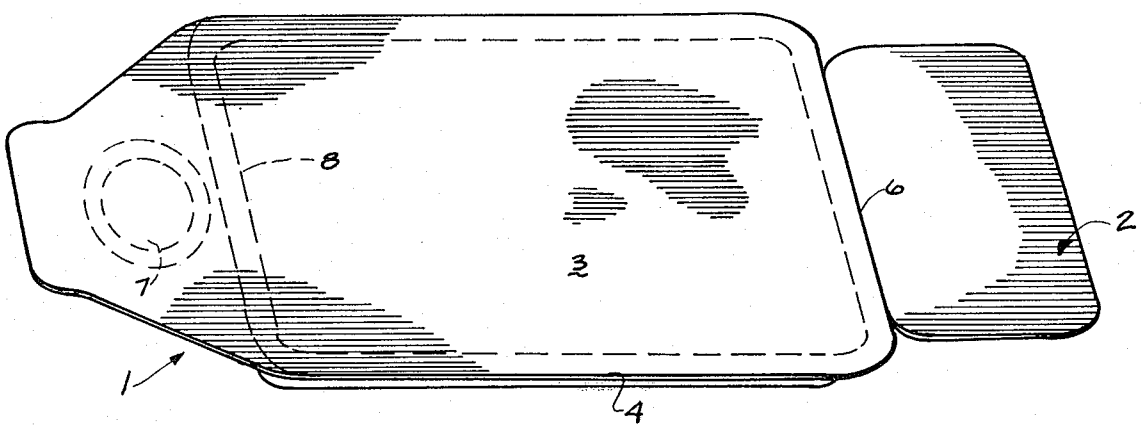
FIG. 1 is a top perspective view of the complete package.
Figure 2:
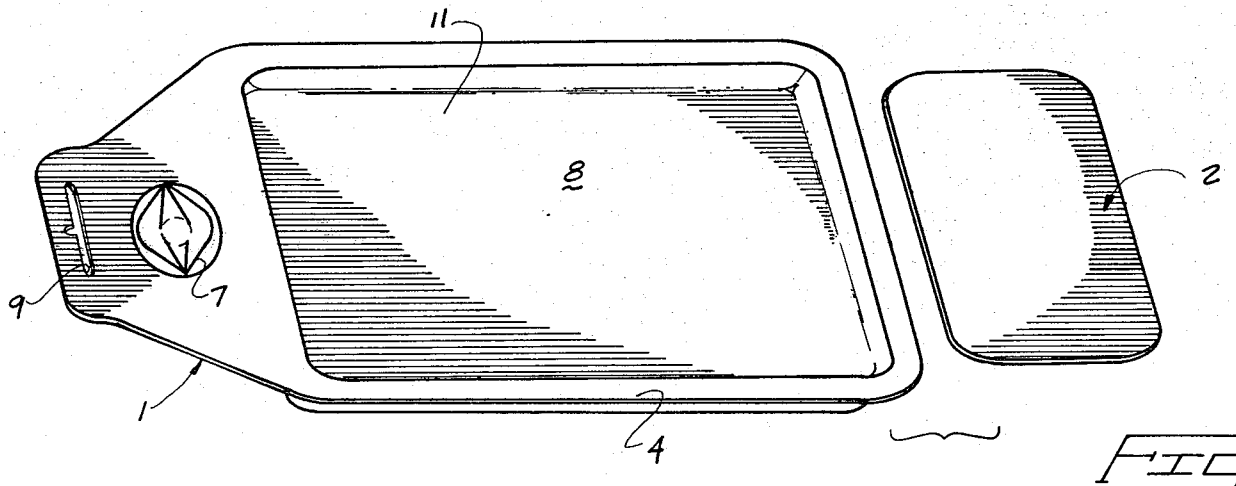
FIG. 2 is a similar perspective view of the package with the cover removed and the paddle separated.
Figure 3:
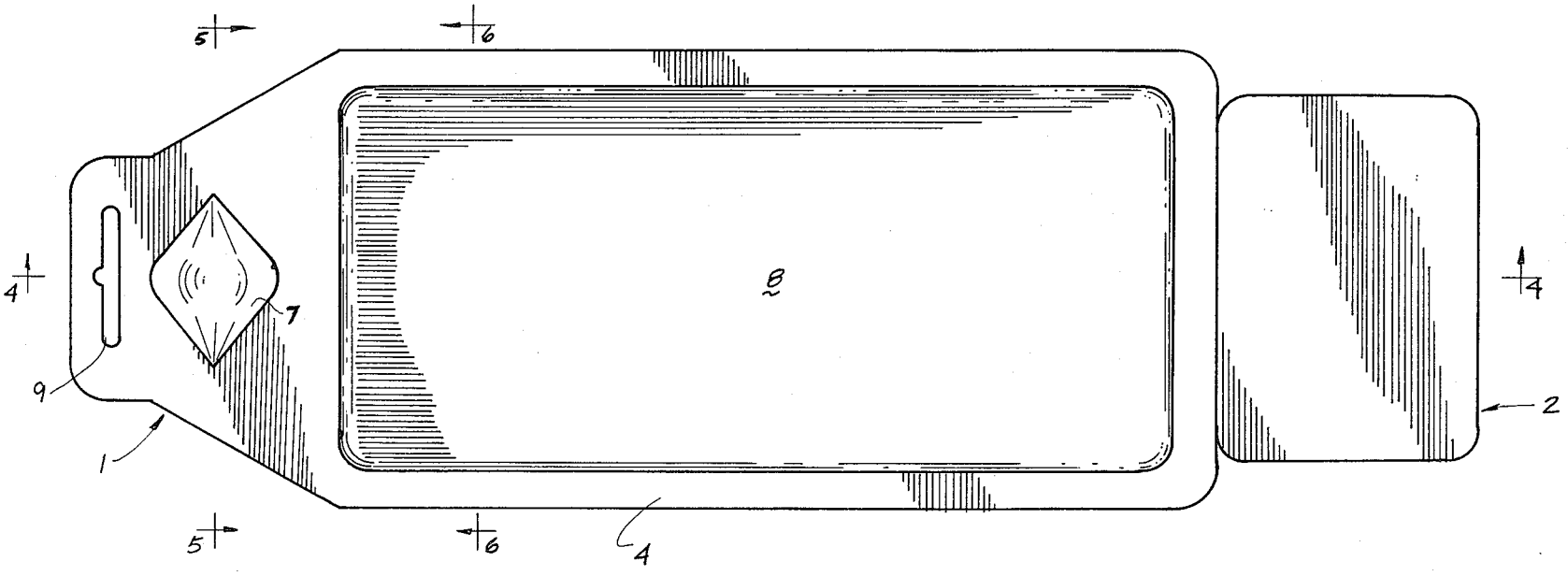
FIG. 3 is a top plan view of the tray and attached paddle.

The specific package illustrated in the drawings was developed for storing and mixing of material components used in thermosetting fillers designed for body shops in the automobile repair industry. Such fillers are used in surface preparation prior to painting of repaired body panels. The fillers typically are mixed from a base putty and a semi-liquid curing agent. However, it is to be understood that the present package is not limited to this one application or to the handling of any specific material components, whether powdered, liquid or semi-liquid.

The specific package might be molded from thermo plastic resins to form a rigid or semi-rigid tray. It could alternately be heat-formed from formable sheet materials. Any suitable material can be utilized in the formation of the package, which could be formed of metal, paperboard, or various combinations of sheet laminates.

The depression used for storing of the base putty is illustrated as being rectangular in shape, although other geometric shapes could be utilized for this purpose. The depression provided for storage of the curing agent is normally smaller than that provided for the base compound because of the typical mixing ratios encountered in such thermal setting systems.

The details of a first embodiment of the package are shown in FIGS. 1 through 6. As illustrated in FIG. 1, the package basically comprises a molded tray 1, a tool or paddle 2, and a cover 3. The tray 1 (FIG. 2) is in the form of an upwardly open container with two or more depressions 7 and 8 having ramp surfaces extending upward to a planar upper surface 4. Surface 4 is continuous about the tray 1. The depressions are used to store individual material components (not shown) for subsequent mixing with one another.

The tool or paddle 2 is illustrated as having a rectangular shape with opposed planar surfaces 5 bounded by four side edges 9 intersecting one another at rounded corners.

The tray 1 is designed to facilitate storage and shipping of two material components within the separate depressions 7 and 8. The boundaries of these depressions are preferably enclosed by a sheet cover 4 of laminated material secured to surface 4 about the periphery of each depression by an adhesive bond. Cover 3 prevents accidental mixing of the material components until their ultimate preparation for usage.

Both depressions 6 and 7 are formed with a cross-sectional configuration complementary to the configuration of the intersecting side edges 9 of the paddle 2. Because of this relationship, material within the depressions can be removed by a continuous movement of the intersecing edges of the paddle through the depression. The movement required varies with the depression configuration illustrated in the several embodiments.

Figure 4:
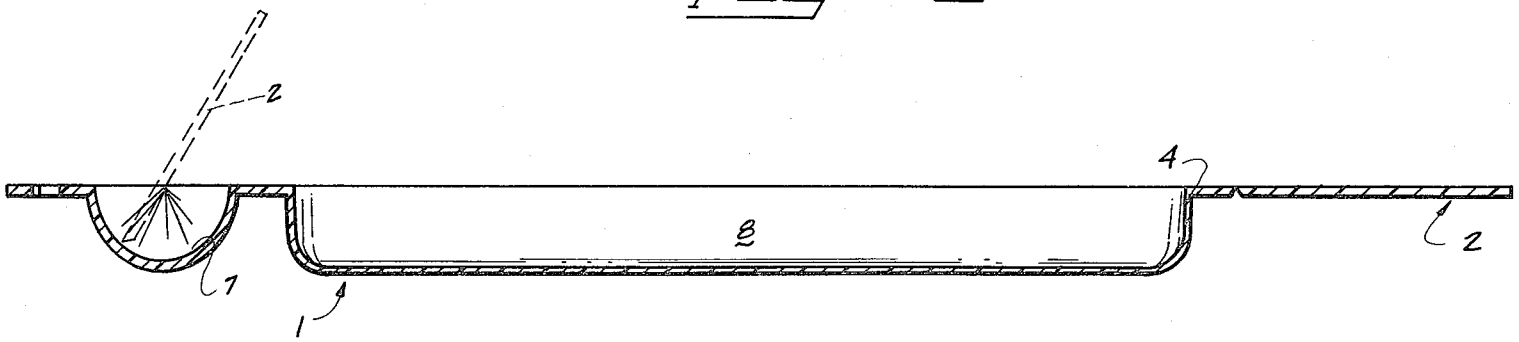
FIG. 4 is a sectional view taken along line 4—4 in FIG. 3.
Figure 5:
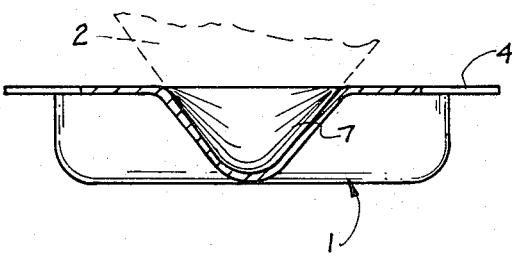
FIG. 5 is a sectional view taken along line 5—5 in FIG. 3.
Figure 6:
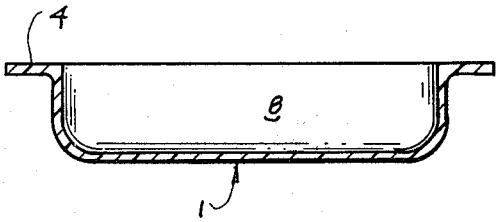
FIG. 6 is a sectional view taken along line 6—6 in FIG. 3.

With respect to the smaller depression 7 shown in FIGS. 1 through 6, its transverse cross-sectional configuration is complementary to the intersection of edges 9 at a single corner of the paddle 2. This relationship is best illustrated in FIGS. 4 and 5, which schematically illustrate the paddle position in the depression 7 as seen along perpendicular cross-sectional planes.

The depression 7 has an upwardly facing ramp 10 formed continuously through its interior. Ramp 10 intersects surface 4 along a periphery formed about depression 7 which includes two opposed corners 11 and 12. The corners 11 and 12 are each complementary to the edge configuration of a single corner of the paddle 2. The depression 7 is transversely symmetrical about a central plane which lies along section line 5—5 in FIG. 3. The surface configuration of ramp 10 is complementary to the locus or path of the intersecting edges 9 at a corner of paddle 2 when the paddle is pivoted about an axis in the plane of upper surface 4 between a substantially horizontal position fitted into one corner 11 or 12 and a position perpendicular to surface 4. Such movement is accomplished by pivotally supporting the side edges 9 of the paddle 2 at the remaining corners 13 and 14 of the depression 7.

Stated differently, the bottom of ramp 10 along its longitudinal center line has an inner arcuate surface centered about an axis positioned transversely across the upper surface 4. This arcuate configuration is illustrated in FIG. 4. Paddle 2 can be moved in one continuous movement from corner 11 to corner 12, thereby removing substantially all of the material from the interior of depression 7. This assures accurate delivery of the stored material onto a planar paddle surface for transfer into the mixing depression 8.

Depression 8 also has a cross-sectional configuration complementary to the configuration of the intersecting edges 9 of the paddle. Its rectangular shape is preferably of a width substantially equal to the width across paddle 2. Its corners are each formed at a radius complementary to the corner radius at each corner of the flat paddle 2. Thus, the paddle 2 can be moved downward into one end of depression 8, along its length, and upward at the remaining end to again substantially remove all of the material from within the depression 8. Prior to such removal, the paddle 2 can also be used for mixing materials within depression 8.

The package presents a completely self-contained integral unit for storing, mixing and delivering two component resin systems, or any multiple component system which must be mixed prior to use. It eliminates the need for unattached or additional containers for either mixing or storing of material components. It assures accurate measurement of components for mixing purposes. It lends itself particularly to one use in the packaging of systems where relatively small amounts of component materials are mixed for immediate use.

The material used in the production of the tray and cover will vary with its application to a particular component system. The materials used must obviously be inert to the chemical stored within the tray. In certain instances it might be advisable to line the interior surfaces of depressions 7 or 8, such as by bonding foil or plastic resin sheets to the surfaces either during or after the forming of the depressions.

Any suitable method can be used for securing cover 3 to tray 1. For instance, the free edges of the tray 1 might include a peripheral flange adhered to the cover 3.

The cover 3 might be manufactured from any suitable material, including paper, plastic sheets, metal sheets or a laminate of such materials. A specific example might include an inner surface of plastic resin, a central sheet of metal foil, and a backing laminate of paper at the outside of cover 3, which can be imprinted with any desired information.

The tool or paddle 2 need not be formed integrally with the tray 1, but is preferably joined along a line of weakness 6 to facilitate delivery of the tool or paddle 2 along with each tray 1. Since the configuration of the depressions within tray 1 match the paddle configurations, it is important to assure delivery of the paddle with each tray.

Figure 7:
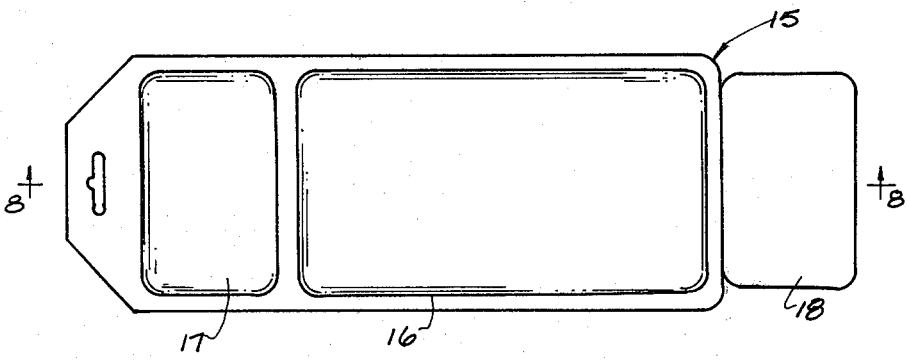
FIG. 7 is a top plan view of a second embodiment.
Figure 8:
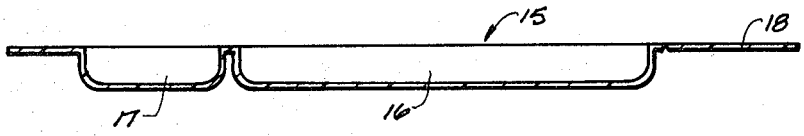
FIG. 8 is a sectional view taken along line 8—8 in FIG. 7.

FIGS. 7 and 8 show an alternate form of the tray, generally designated by the numeral 15. Tray 15 includes a rectangular mixing depression 16 and a rectangular added component depression 17, both having the general rectangular shape previously described with respect to depression 8 in FIGS. 1–6. The complementary rectangular paddle 18 is used to deliver material from depression 17 to depression 16, is then used for mixing the two components, and is finally available for delivering the prepared mixture from tray 15. Its size and shape is again complementary to the size and shape of depressions 16 and 17, assuring accurate delivery of the material components for mixing purposes and complete material utilization. The size ratios between the respective depressions 16 and 17 can be varied depending upon the desired volume mixture ratios required in a particular multiple component system.

FIGS. 9 and 10 show another tray configuration. This tray 20 includes an elongated material component depression 21 and a square mixing depression 22. The elongated depression 21 is again complementary in shape to one corner of the associated paddle 23. Each longitudinal end of the depression 21 is formed with a ramp configuration identical to that previously discussed with respect to depression 7, in FIGS. 1–6, with a connecting center ramp section of continuous width having a constant cross-sectional configuration throughout its length. A corner of paddle 23 can therefore be arcuately projected downward through one end of the depression 21 and moved along its length to its opposite end, completely removing material from within depression 21. The material can then be mixed in depression 22, which is essentially identical to the previously described details of depression 8 in FIGS. 1–6.

FIGS. 11 and 12 illustrate a slightly different arrangement of the removable paddle 25 on a fourth form of the tray 26. Paddle 25 is located within the rectangular confines of the tray and is placed alongside a tray section containing a short rectangular depression 27. Again, the corner configurations of the depression 27 complement the intersecting edges at one end of paddle 25. While the cross-sectional configuration of the larger mixing depression 28 complements the configuration of the intersecting edges of paddle 25, the width across depression 28 is substantially greater than that across paddle 25. It will therefore require at least two longitudinal movements of paddle 25 through the length of depression 28 to totally removal all material from within it.

While the specific forms of the invention shown in the drawings illustrate two depressions or compartments for storing of the material components for future mixing, it is to be understood that additional depressions can be formed in the tray where additional material components are required. For instance, a particular system might include several depressions for material components of differing colors, the particular color being selected by the end user. In such a case, multiple depressions such as that shown at 7 in FIGS. 1 through 6 might be included along a common flange or upper surface at positions adjacent to the larger storage and mixing depression 8. Material can then be delivered from one or any combination of such depressions to the depression within which mixing is accomplished.

The above apparatus assures delivery of multiple material components for mixing purposes in accurate quantities and ratios. It's use results in substantial savings of time otherwise required for careful measurement of quantities and substantially reduces the possibility of error. Furthermore, the single package provides all components required in multi-component mixing systems, together with a tool specifically designed for accurate material component delivery and mixing. This substantially reduces storage requirements and inventory complexities.

The package can be manufactured in any size for use by commercial users or for use in the home. It assures properly mixed fresh components. The package insures that wastage of materials is minimized and that there is virtually no possibility of contamination prior to use.

What is claimed is:

1. A tray for storage and mixing of individual material components, said tray comprising:

an upwardly open container bounded by side and end edges and including two or more depressions located within its edges, said depressions being adapted to respectively store individual material components for subsequent mixing with one another;

a flat paddle having intersecting edges along its periphery, said paddle being integrally formed as part of the container along one of its edges and being detachable from the container along said one edge by a joining line of weakness;

one of said depressions having a cross-sectional configuration complementary to the configuration of the intersecting edges of the paddle;

whereby material within said one depression can be removed from it by a continuous movement of the paddle through the depression while said intersecting edges thereof engage the cross-sectional configuration of said depression complementary thereto.

2. A tray as claimed by claim 1 wherein a second of said depressions also has a cross-sectional configuration complementary to the configuration of intersecting edges of the paddle.

3. A tray for storage and mixing of individual material components, said tray comprising:

an upwardly open container bounded by side and end edges and including two or more depressions located within its edges, said depressions being adapted to respectively store individual material components for subsequent mixing with one another;

a flat rectangular paddle having opposed planar surfaces bounded by four side edges intersecting one another at four corners along its periphery, said paddle being integrally formed as part of the container along one of its edges and being detachable from the container along said one edge by a joining line of weakness;

one of said depressions having a cross-sectional configuration complementary to the configuration of the intersecting edges of the paddle;

whereby material within said one depression can be removed from it by a continuous movement of the paddle through the depression, while said intersecting edges thereof engage the cross-sectional configuration of said depression complementary thereto.

4. A tray as claimed in claim 3 wherein the individual depressions are bounded by a planar upper surface extending between them in an integral unit;

said one depression having an upwardly facing ramp intersecting the upper surface along a periphery having two opposed corners, each corner being complementary to one corner of the paddle.

5. A tray as claimed in claim 3 wherein the individual depressions are bounded by a planar upper surface extending between them in an integral unit;

said one depression having an upwardly facing ramp intersecting the upper surface along a periphery having two opposed corners, each corner being complementary to one corner of the paddle, said ramp having a surface configuration complementary to the locus of the intersecting edges of said one corner of the paddle when pivoted about an axis in the plane of the upper surface between a substantially horizontal position fitted into one of said opposed corners to a position perpendicular to said upper surface.

6. A tray as claimed in claim 3 wherein said one depression is bounded by a planar upper surface;

said one depression having an upwardly facing ramp with a surface configuration complementary to the locus of the intersecting edges of the paddle when fitted into the depression and moved along the ramp while held in a position substantially perpendicular to said upper surface.

* * * * *